United States Patent [19]

Setterberg, Jr.

[11] Patent Number: 4,502,536

[45] Date of Patent: Mar. 5, 1985

[54] SUBMERSIBLE PUMP

[75] Inventor: John R. Setterberg, Jr., Richardson, Tex.

[73] Assignee: Otis Engineering Corporation, Dallas, Tex.

[21] Appl. No.: 489,537

[22] Filed: Apr. 28, 1983

[51] Int. Cl.[3] ..... E21B 43/12; E21B 34/16; E21B 34/10

[52] U.S. Cl. ..... 166/105.5; 166/106; 166/370

[58] Field of Search ..... 166/68, 105, 105.5, 166/106, 369, 370

[56] References Cited

U.S. PATENT DOCUMENTS

| | | | |
|---|---|---|---|
| 2,349,164 | 5/1944 | Gilbert | 166/105.5 |
| 3,643,740 | 2/1972 | Kelley | 166/68 |
| 3,675,720 | 7/1972 | Sizer | 166/68 |
| 3,746,081 | 7/1973 | Vencil | 166/106 |
| 4,354,554 | 10/1982 | Calhoun et al. | 166/106 |
| 4,387,767 | 6/1983 | Read | 166/72 |

OTHER PUBLICATIONS

"Composite Catalog of Oil Field Equipment & Services", 1982–1983, p. 1579.

*Primary Examiner*—Stephen J. Novosad
*Assistant Examiner*—Mark J. DelSignore
*Attorney, Agent, or Firm*—Vinson & Elkins

[57] ABSTRACT

A submersible pump system for petroleum production in which the pump is suspended from an H-member with production passing up one leg of the H-member and gas passing up the other leg of the H-member. Valve means provide for alternately directing the liquid in a recirculating path through the H-member to the pump while closing in gas flow and closing the cross-member in the H-member and providing for gas and liquid flow through the separate legs of the H-member. The system is coordinated with a subsurface safety valve in the tubing above the H-member and the valve means and subsurface safety valve are controlled by the same pressure line.

7 Claims, 4 Drawing Figures

SUBMERSIBLE PUMP

This invention relates to petroleum production systems and more particularly to a production system employing a submersible pump.

Many flowing wells can have their production greatly enhanced by utilizing a submersible pump to lift the liquid to the surface. Such systems are well known. See U.S. Pat. No. 4,354,554 issued Oct. 19, 1982 to Calhoun, et al. See also page 1579 of the 1982–1983 *Composite Catalog of Oil Field Equipment and Services.*

It is further known to produce liquids with a submersible pump through a dual packerand a subsurface safety valve for controlling flow through the tubing. Gas flow is through the other leg of the dual packer and up through a small conduit to a valve landed in a side pocket in the production tubing. Gas flow passes through this valve into the casing when the side pocket valve is open. A surface control line is pressurized to control the side pocket valve and the subsurface safety valve so that both valves may be closed and opened simultaneously providing for liquid and gas flow with the former in the tubing and the latter in the annulus. No provision is made for circulation to the pump when the valves are closed. This is objectionable as the pump may be damaged if run while the valves are closed.

The patented system referred, the controls separate flow of liquid and gas and provides for circulation for the pump when the valves are closed. The system, however, utilizes a tailpipe from the subsurface safety valve to control gas flow and to provide for circulation when the valves are closed. This apparatus greatly restricts the flowway to the surface and prevents the pump from attaining its maximum efficiency in a given size of tubing. The valve must be positioned adjacent to the pump to prevent the weight of the tailpipe from making the valve inoperable.

It is an object of this invention to improve this patented structure by providing the same functions of circulation and control of flow of liquids and gas in the two separate conduits without restricting flow through the tubing.

It is further desirable to be able to determine through sonic procedures the level of liquid in the tubing-casing annulus below the packer. To accomplish this suitable passageway through the packer must be present and the number of turns in such passageway and the length of the restricted area of the passageway should be as small as possible.

Another object of this invention is to provide a submersible pump system for petroleum wells in which full control of the well is maintained including provisions for recirculating through the pump while providing for full unobstructed flow through the tubing and positioning the pump and subsurface safety valve at optimum levels.

Another object is to provide a submersible pump system in which full control of the well is maintained, the pump and subsurface safety valve are at optimum levels and control of gas flow and recirculation of liquid to the pump when the safety valve is closed is controlled outside of the tubing so as not to interfere with normal flow when the safety valve is open.

Another object is to provide a system as in the preceding objects in which fluid levels may be determined by shooting fluid levels down the tubing-casing annulus.

Other objects, features and advantages of this invention will be apparent from the drawings, the specification and the claims.

In the drawings wherein like reference numerals indicate like parts, and wherein illustrative embodiments of this invention are shown:

Figure 1:
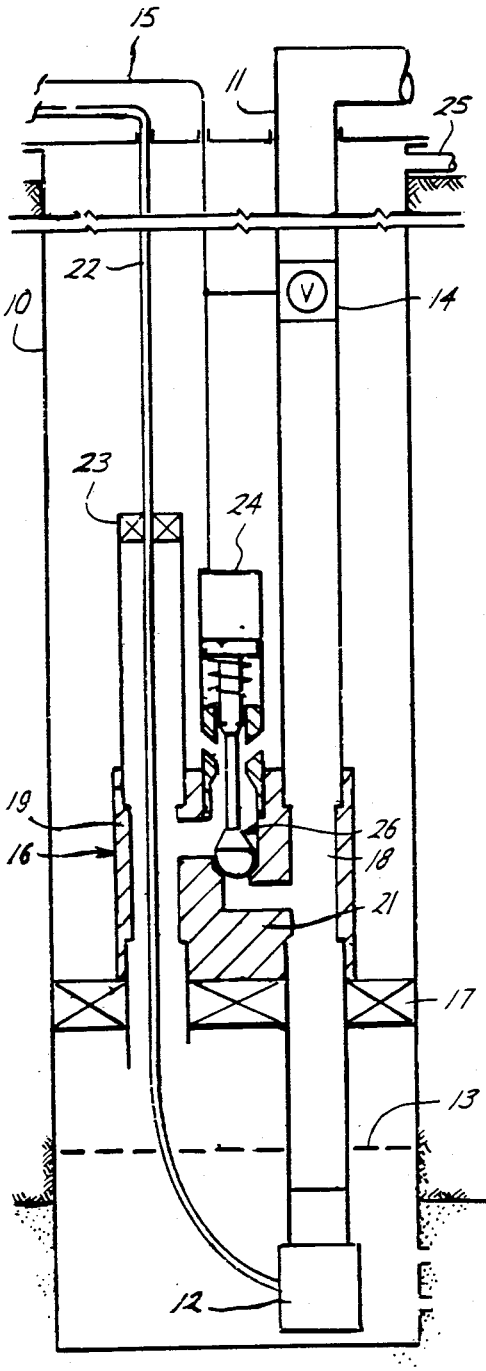
FIG. 1 is a schematic illustration of one form of this invention.

Referring first to FIG. 1, the well is provided with the casing 10 in which there is suspended the conventional production tubing 11. The well will normally be one which is capable of flowing but flows at a low rate. In order that this rate of flow be increased, a submersible pump 12 is carried on the lower end of the tubing 11 and positioned below the normal liquid level 13 in the well.

In accordance with this invention provisions are made for complete control of liquid flow through the tubing 11 and gas flow through the tubing 11-casing 10 annulus so that the well may be shut-in at any time and particularly in response to emergency conditions. The system further provides for automatic recirculation of liquid when the well is shut-in so that liquid is always available to the submersible pump to prevent it from being damaged.

To control flow through the tubing, conventional pressure controlled subsurface safety valve 14 is provided. As the operation of this valve is completely separate from circulation control valve, it may be positioned at the optimum level within the well taking all factors into consideration. This control valve 14 will be conventional in form and will be opened in response to an elevated pressure in the control pressure line 15. Reduction of pressure in the line 15 results in closing of the safetyvalve 14.

A H-member 16 and an associated packer 17 are carried by the tubing 11. One leg 18 of the H-member is made up in and forms a part of the tubing 11 in the conventional manner.

The other leg 19 of the H-member provides for gas flow to the cross-member of the H-member and for recirculation of liquids from the pump 12.

The electrical cable 22 extends through the leg 19 of the H-member to the submersible pump 12 to provide power for the pump. A suitable packing 23 packs off between the cable and the upper portion of leg 19 to prevent flow from the upper end of leg 19.

A conduit 24 provides fluid communication with and extends upwardly from the cross-member 21 of the H-member. This conduit provides for flow of gas from the lower secton of the leg 19 through the cross-member 21 and out through the leg 24 into the tubing-casing annulus. Thus, as gas is released from the liquid in the bottom of the well, it is free to make its way to the casing above the packer 17 and leave the well through the conduit 25 at the surface.

Control of flow through the cross-member 21 of the H-member is provided by the two-way valve 26 which in the position illustrated provides for gas flow past the packer 17. This valve is pressure controlled by pressure within line 15. When the safety valve 14 is open for production, the two-way valve 26 is in the position shown to provide for gas flow past the packer 17. When the pressure within line 15 is reduced to close the safety valve 14, it shifts two-way valve 26 to block flow through the outlet leg 24 and to communicate leg 19 with leg 18 of the H-member to provide for circulation of liquid through the H-member to return the liquid to the pump 12 and prevent any possibility of damage to the pump if it is running while the well is shut-in.

With the arrangement shown, not only may the subsurface safety valve 14 be positioned at its optimum depth, but the pump and H-member may also be positioned at their optimum depth.

Figure 3:
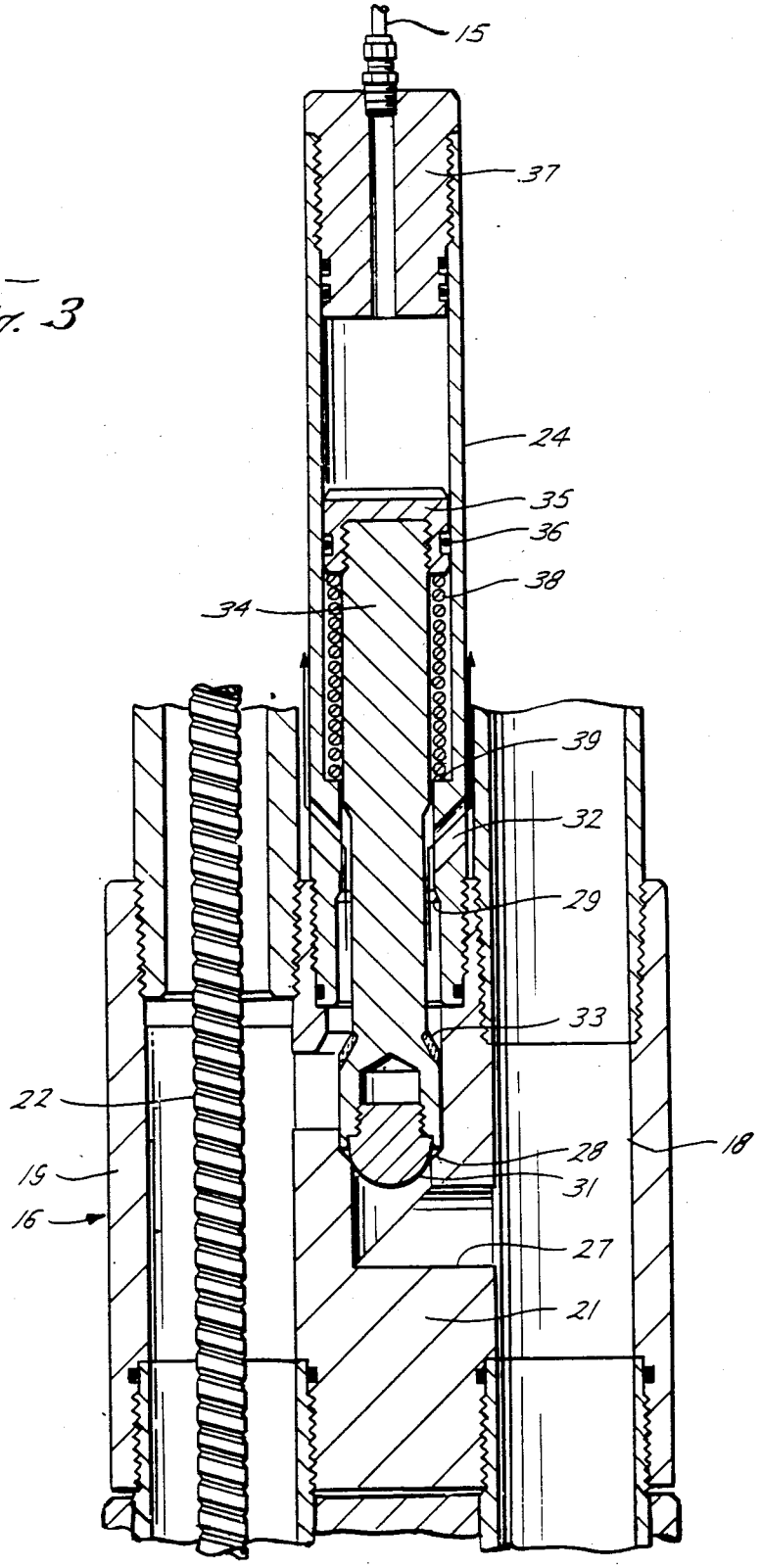
FIG. 3 is a fragmentary sectional view on an enlarged scale of the H-member and two-way control valve of FIG. 1.

FIG. 3 shows a form of two-way valve which may be utilized with this invention.The cross-member 21 has a flowway 27 therethrough with an upwardly facing seat 28 and a downwardly facing seat 29.

A valve member having a downwardly facing seal element 31 engageable with seat 28 and an upwardly facing seal element 33 engageable with the seat 29 to control flow through the passageway 27 in the cross-member 21.

The seat 29 is carried in the third leg 24 and this leg has upwardly and outwardly facing ports 32 through which gas may flow into the tubing-casing annulus when the two-way valve is in the down position illustrated. When the two-way valve is in its up position, the upwardly facing valve seal element 33 engage seat 29 and prevent flow through the ports 32. In the up position, the valve seal element 31 is spaced from its cooperative seat 28 to provide for flow through the flowway 27 in the cross-member 21 for recirculation of liquid to the pump.

A valve stem 34 carries the valve seal elements 31 and 33. This stem has a cap 35 at its upper end which has a sliding seal with leg 24 provided by th seal 36. A plug 37 closes the upper end of the leg 24 and the control pressure line 15 communicates with the plug 37 to pressurize the leg 24 above the cap 35. Thus, when pressure is maintained on the control pressure line 15 the valve is held in the position shown in FIG. 3.

When the pressure is removed from line 15, the compression spring 38 held between the cap 35 and an upwardly facing shoulder 39 in the leg 24 expands to move the valve upwardly to disengage the element 31 from its seat 28 and to engage element 33 with its seat 29 to prevent gas flow through the H-member and provide for recirculation of liquid from the leg 18 through the cross-member passageway 27 and down through the leg 19 to return to the pump.

The two-way valve shown is a permanent part of the the H-member. It could, however, be a retrievable valve, as taught in U.S. Pat. No. RE. 28,588 to Sizer, et al, reissued Oct. 28, 1975.

It is desirable to permit sonic measurement of the level of liquid within the casing and below the packer 17. To provide for such measurement, the obstructions to sound waves and the number and severity of bends which such waves must take should be minimized as much as possible. The distance between the gas ports 32 and the liquid level is preferably minimized.For this purpose the flow ports 32 are angled upwardly and outwardly and the valve element 33 of the two-way valve is preferably at the upper portion of the cross-member passageway 27 when the two-way valve is in its down position so that sonic waves will freely pass the valve element 33 and reach the leg 19 of the H-member with a minimum number of turns as illustrated. The valve stem 34 is reduced in diameter between the ports 32 and the seat 33 relative to the leg 24 to provide ample space for sound waves to pass downwardly through the two-way valve.

Figure 2:
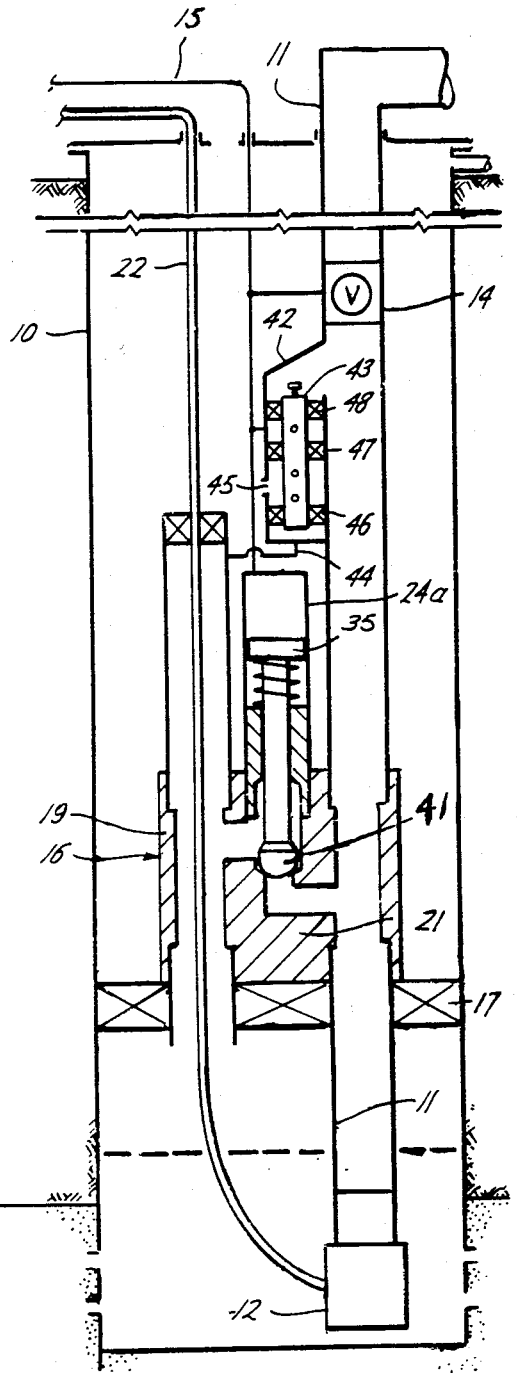
FIG. 2 is a schematic illustration of a modified form of this invention.

Another form of this invention is shown in FIG. 2. In this invention the two-way valve 26 of FIG. 1 is separated into two valves and the valve 41 controls recirculation of liquid through the H-cross-member 21 in response to pressure conditions within the control pressure line 15 in the manner hereinabove explained.

At a point in the tubing above the H-member a gas control valve is provided. Preferably, this is of the removable form and for this purpose a side pocket mandrel 42 is provided in the tubing in which a gas control valve 43 is positioned. This valve is insertable and removable from the tubing 11 using conventional wireline techniques. A gas line 44 extends from the upper end of H-member leg 19 to the lower end of the side pocket mandrel 42. The valve 43 provides for control of flow from the lower end of the side pocket mandrel 42 to the ports 45 which communicate the side pocket mandrel with the casing in an area between the packing 46 and 47. The valve 43 is controlled by pressure in the line 15 which communicates with the side pocket mandrel between the packing 47 and the upper packing 48. With the control pressure line 15 pressurized, the valve 41 is held on its seat so that fluid production will be through conduit 11. The valve 43 is open when subjected to pressure and gas flow passes from line 44 through the ports 45 and into the tubing-casing annulus. When control pressure is reduced in line 15, valve 43 closes to close in gas flow and subsurface safety valve 14 also closes to shut-in fluid flow. At the same time, the circulation control valve 41 opens to provide for circulation of fluid in the event the pump is running while the well is shut-in.

Figure 4:
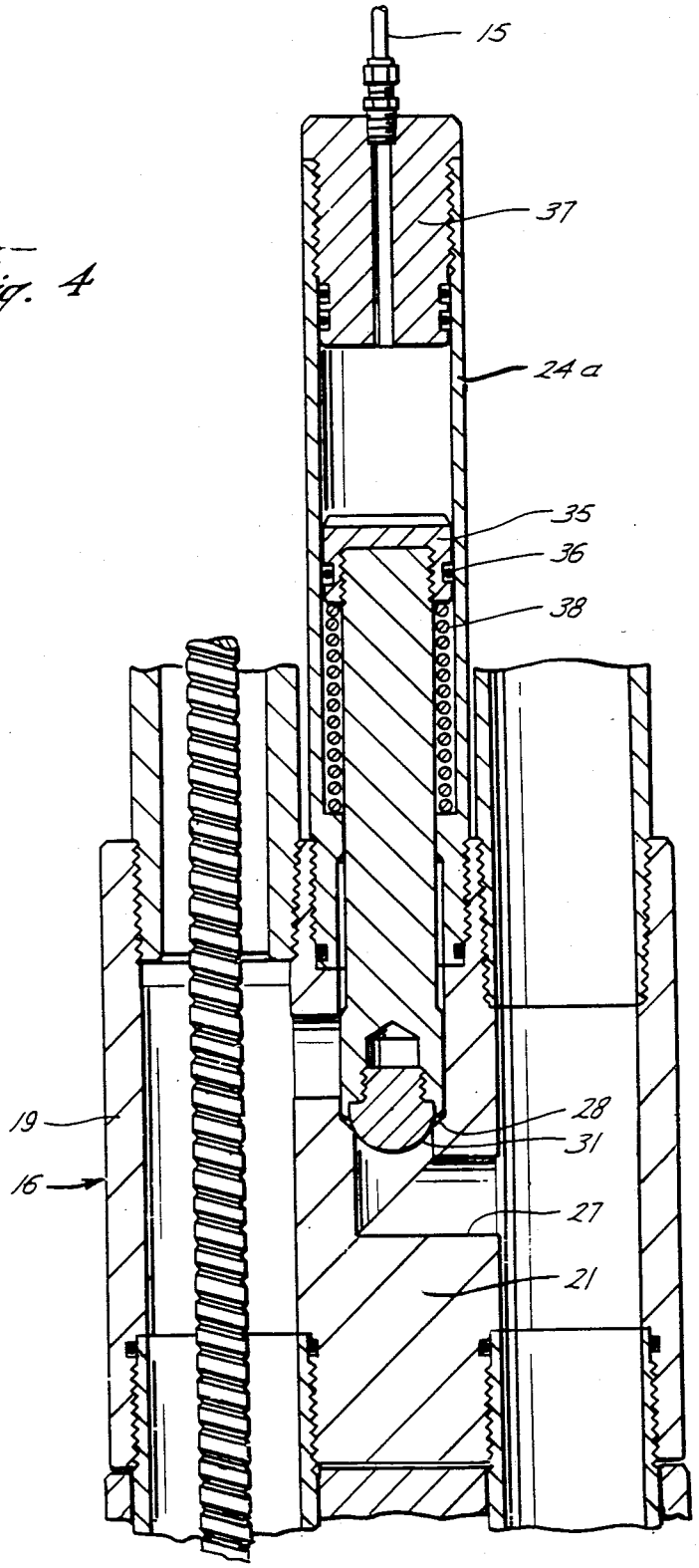
FIG. 4 is a fragmentary sectional view on an enlarged scale of the H-member and circulation control valve of FIG. 2.

A suitable valve for use in the system shown schematically in FIG. 2 is shown in FIG. 4. This valve is identical to the valve shown in FIG. 3, except that there are no side ports 32 in leg 24*a* and only function of the valve is to control recirculation by cooperation of the valve seal element 31 and seat 28. As in the valve of FIG. 3, when pressure is reduced in line 15 the spring 38 moves the valve seal element 31 away from its seat to permit fluid circulation between the lower legs of the H-member.

This valve may also be a retrievable valve, if desired.

The form of the subsurface safety valve 14 is not shown, but it is preferred that this valve be a tubing valve, that is, made up as a part of the tubing, so that the tubing may be unobstructed or obstructed to a minimum amount to provide for full open flow from the pump 12 through the tubing 11 and valve 14 to the surface. It is highly desirable to provide for this unobstructed flow to obtain maximum efficiency from the pump 12 and for this reason all of the control of gas and recirculation is provided outside of the flowway through the tubing 11 so that the tubing will be unobstructed.

The foregoing disclosure and description of the invention is illustrative and explanatory thereof and various changes in the size, shape and materials, as well as in the details of the illustrated construction, and may be made within the scope of the appended claims whithout departing from the spirit of the invention.

What is claimed is:

1. A petroleum production system comprising;

a well tubing, a surface controlled subsurface safety valve in the tubing, a well packer and associated H-member in the tubing belowe the safety valve with one leg of the H-member forming a part of said well tubing, a submersible pump carried by the tubing below the packer, two-way valve means in the H-member providing in one position for liquid circulation upwardly from said one leg through the cross member and downwardly through said other leg of the H-member to provide for circulation through the pump and simultaneously preventing gas flow from said other leg, said two-way valve means providing in the other position for gas flow from said other leg and preventing flow through said cross-member, said two-way valve means including resilient means urging the valve means toward said one position and a pressure responsive member urging said two-way valve means toward said other position when pressure is increased on said pressure responsive member, means controlled from the surface for pressurizing said pressure responsive member, said valve means when pressurized closing the cross member of the H-member and providing for gas flow from the other leg of the H-member, said valve means when depressurized opening said cross member to provide for liquid circulation to said pump and preventing flow of gas from said other leg of the H-member.

2. A petroleum production system comprising;

a well tubing, a surface controlled subsurface safety valve in the tubing, a well packer and associated H-member in the tubing below the safety valve with one leg of the H-member forming a part of said well tubing, a submersible pump carried by the tubing below the packer, firstvalve means controlling flow through the cross member of said H-member and resiliently urged toward open positionand closed in response to an increase in pressure, a second valve controlling gas flow from the second leg of the H-member and resiliently urged toward closed position and opening in response to an increase in pressure, means controlled from the surface for pressurizing siad first and second valves, said valves when pressurized closing the cross member of said H-member and providing for gas flow from the other leg of the H-member, said valves when depressurized opening said cross member to provide for liquid circulation to said pump and preventing flow of gas from said other leg of the H-member.

3. The system of claim 1 or 2 wherein the pressurizing means for the valve means supplies pressure to the subsurface safety valve and when the valve means is in said one position said subsurface safety valve is closed.

4. The system of claim 1 or 2 wherein the pump is an electric pump and the electrical conduit for said pump extends through said other leg of the H-member.

5. The system of claim 1 or 2 wherein said subsurface safety valve provides a part of the tubing.

6. The system of claim 1 or 2 wherein said valve means is a retrievable valve mounted in side pocket mandrel means accessible through said tubing.

7. The system of claim 2 wherein at least one of said first and second valves is a retrievable valve mounted in side pocket mandrel means accessible through said tubing.

* * * * *